United States Patent [19]

Taylor

[11] Patent Number: 4,754,907

[45] Date of Patent: Jul. 5, 1988

[54] STRIP FEEDING APPARATUS

[76] Inventor: Allan D. Taylor, 1450 Piedera Dr., Walnut Creek, Calif. 94596

[21] Appl. No.: 493,056

[22] Filed: May 9, 1983

[51] Int. Cl.[4] ..... B65H 27/00; B65H 20/00

[52] U.S. Cl. ..... 226/190; 226/151

[58] Field of Search ..... 242/107.4 R, 107.4 A, 242/107.4 B, 107.4 C, 107.4 D, 75.2; 226/194, 190, 195, 168, 109, 151, 147, 128, 162, 166, 167, 146, 165

[56] References Cited

U.S. PATENT DOCUMENTS

| | | | |
|---|---|---|---|
| 445,344 | 1/1891 | Hartsuff et al. | 226/167 |
| 2,787,464 | 4/1957 | Davidson et al. | 226/109 |
| 2,851,267 | 9/1958 | Davidson | 226/109 X |
| 2,862,708 | 12/1958 | Allen | 226/109 |
| 2,998,905 | 9/1961 | Bieber | 226/194 X |
| 3,010,565 | 11/1961 | Pasinski | 226/194 X |
| 3,081,015 | 3/1963 | Stickel | 226/168 |
| 3,125,374 | 3/1964 | Bissell | 242/107.4 R |
| 3,556,376 | 1/1971 | Offterdinger | 226/165 X |
| 3,972,461 | 8/1976 | Zahradnik et al. | 226/196 X |
| 3,997,095 | 12/1976 | Lamb | 226/109 X |
| 4,050,361 | 9/1977 | Traise | 226/195 X |
| 4,054,235 | 10/1977 | Witcher | 226/195 X |
| 4,059,213 | 11/1977 | Toomay | 226/165 X |
| 4,431,126 | 2/1984 | Jones | 226/121 |

FOREIGN PATENT DOCUMENTS

| | | | |
|---|---|---|---|
| 515252 | 11/1939 | United Kingdom | 226/147 |

*Primary Examiner*—Harvey C. Hornsby
*Assistant Examiner*—Scott J. Haugland

[57] ABSTRACT

An apparatus is described for feeding various sizes or formats of strip material to a processing apparatus, such as a computer-printer. The apparatus comprises a frame having a vertical feed slot through which strip material is fed and a roll for gripping and supporting the strip within the feed slot, said roll being supported upon an inclined surface such that gravity and friction holds the rolls against the strip material and retains the strip material within the feed slots.

3 Claims, 1 Drawing Sheet

STRIP FEEDING APPARATUS

Figure 1:
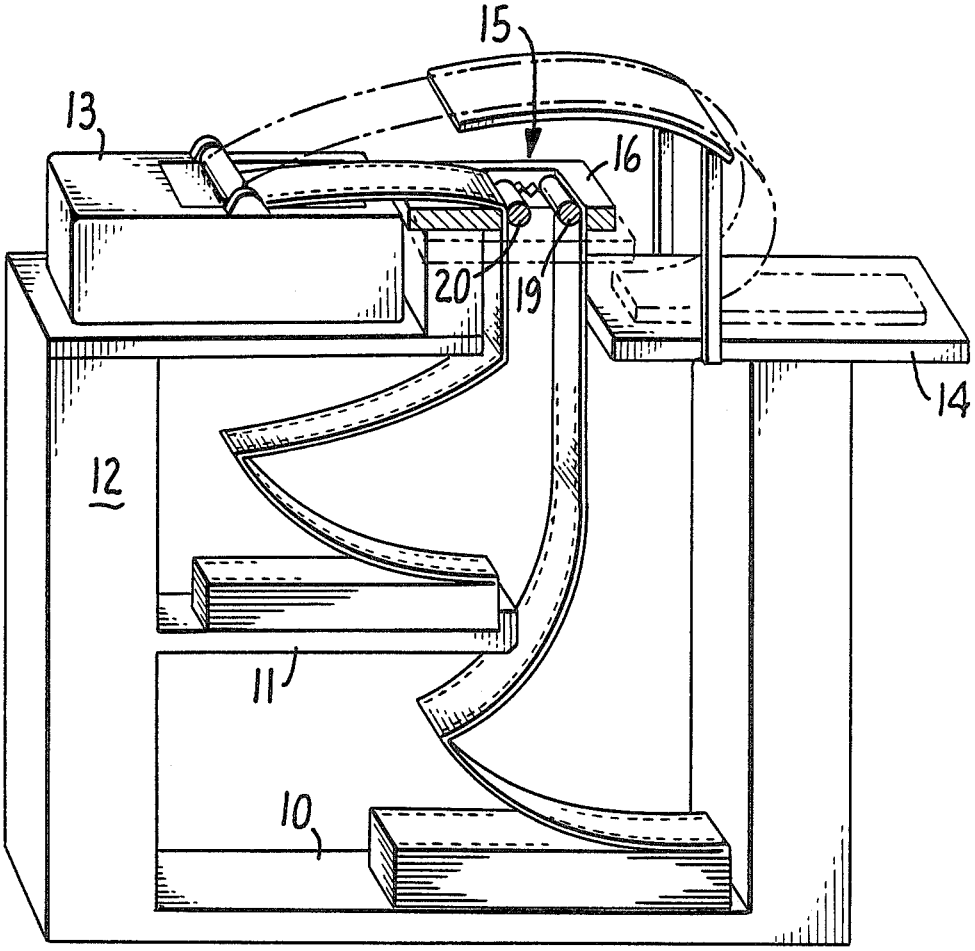

This invention relates generally to an apparatus for gripping and supporting strip material within a feed slot positioned near an apparatus such as a computer-printer. The apparatus described provides means for selectively feeding strip material from several different sources of supply to the printer, thus allowing a change in size or format of the strip material. The invention has particular utility in the construction of an efficient work station for use with computer-printer systems and in the construction of tables, desks and storage bins customarily used with such systems.

One object of the invention is to provide a novel strip feeding apparatus that is inexpensive to manufacture and which may be adapted for use in desks, tables and storage bins as now customarily provided with conventional computer-printers.

Another object is to provide apparatus of the kind described and comprising an arrangement of rolls supported upon inclined surfaces for gravitationally and frictionally engaging strip material within a feed slot and holding the material for selective use in a printer.

Other objects of this invention will become apparant in view of the following detailed description.

Figure 2:
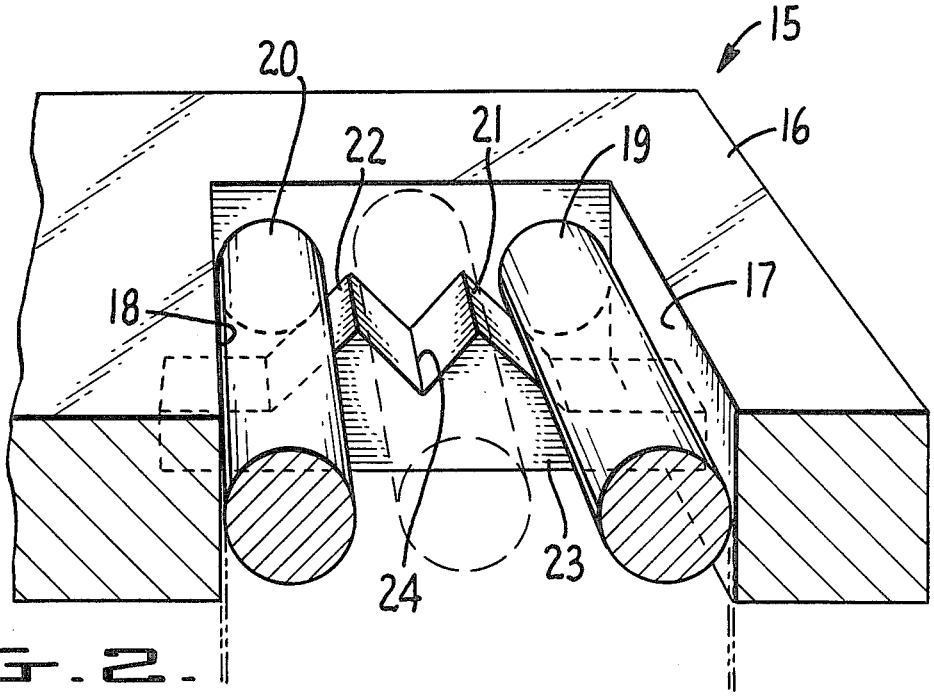

In the drawings forming a part of this application and in which like parts are identified by like reference numerals;

FIG. 1 is a perspective view of a preferred embodiment of the invention in a strip feeding apparatus for a printer; and FIG. 2 is an enlarged perspective of the strip feeding apparatus.

Referring to FIG. 1, a strip feeding apparatus is provided including means for gripping and supporting series connected and accordion pleated strips of material of two different sizes or formats. The strip material is supported on a pair of supply trays 10 and 11, each mounted to an upright stand 12. Strip material from either supply tray may be fed to a printer 13 and collected on a storage tray 14. The arrangement of supply trays is such that each is horizontally displaced from the other, although aligned laterally for feeding the strip material vertically through a feed slot and a mechanism 15 that serves to support and grip the end of strip material fed from either tray.

Referring to FIG. 2, trays 10 and 11 are located beneath an upper frame 16 having a feed slot defined by a pair of parallel horizontal edges 17 and 18. Trays 10 and 11 are also horizontally and vertically offset relative to each other so that the strip material of each can be fed in a generally vertical direction through the feed slot of frame 16 and into close proximate relation to edges 17 and 18, respectively.

Apparatus 15 further comprises a pair of rolls or rollers 19 and 20 and means for supporting those rolls upon inclined surfaces 21 and 22. These surfaces are inclined downwardly in the direction of the parallel edges 17 and 18, respectively. Thus, it will be evident that gravity tends to move the rolls 19 and 20 downwardly on the inclined surfaces 21 and 22, bringing them into contact with strip material fed upwardly between edges 17 and 18, respectively. In this manner, strip material supported upon trays 10 and 11 may be fed through feed slots and frictionally gripped and supported by the rolls. Accordingly, the strip material supplied from either tray may be disengaged from the printer roll, but remain accessible in near proximity to the printer for later use.

The means for supporting rolls 19 and 20 upon inclined surfaces may be provided by one or more blocks 23 secured to the underside of frame 16. In the preferred embodiment shown, block 16 is also formed with a center notch or recess 24, which provides an alternative support position for rolls 20 or 21 whenever a fresh supply of strip material is to be fed through the feed slots of frame 16.

Strip feeding apparatus 15 may be inexpensively manufactured of wood, metal or various plastics, and it may be supplied as an integral part of a table top or desk. For example, the upper surface of a table may serve as the frame 16 and one or more blocks 23 secured to the underside of the table by means of glue, screws or other fastening devices.

Although a preferred embodiment of the invention has been illustrated and described, various modifications and changes may be resorted to without departing from the spirit of the invention or the scope of the appended claims, and each of such modifications and changes is contemplated.

What is claimed is:

1. Apparatus for gripiping and supporting strip material fed from more than one supply and comprising:

a frame having a pair of feed slots defined in part by a pair of parallel and horizontally spaced edges; a support means that provides a pair of inclined surfaces, each surface inclined downwardly in the direction of one of the pair of parallel edges, respectively; each inclined surface being spaced from and in facing relation to one of said horizontally spaced edges, the space between said surfaces and associated horizontal edge defining an opening through which strip material may be passed; a pair of rolls for engaging strip material fed through said feed slots, each roll defining the other side of one of said feed slots, being greater in diameter than the space between the associated horizontal edge and the associated inclined surface, and gravitationally supported upon one of said inclined surfaces; and means for supporting more than one supply beneath said frame; whereby strip material from two different sources of supply are fed through the feed slots and frictionally gripped and supported by the pair of rolls against the pair of parallel and horizontally spaced edges, respectively, said rolls being freely rotatable and moveable up and down said inclined surfaces.

2. The apparatus of claim 1, said means for supporting said rolls including a notched recess for supporting a roll intermediate said pair of inclined surfaces.

3. The apparatus of claim 1, said means for supporting more than one supply comprising a pair of support trays vertically and horizontally offset relative to each other, whereby strip material from two supplies may be fed through the feed slots, respectively and gripped by one of said rolls against one said parallel edges, respectively.

* * * * *